US006801182B2

(12) United States Patent
Yang et al.

(10) Patent No.: US 6,801,182 B2
(45) Date of Patent: Oct. 5, 2004

(54) SCAN DRIVING CIRCUIT AND DRIVING METHOD FOR ACTIVE MATRIX LIQUID CRYSTAL DISPLAY

(75) Inventors: Ho-Hsin Yang, Tainan (TW); Yong-Nien Rao, Taichung (TW); Ya-Hsiang Tai, Hsinchu (TW)

(73) Assignee: Prime View International Co., Ltd., Hsin-chu (TW)

( * ) Notice: Subject to any disclaimer, the term of this patent is extended or adjusted under 35 U.S.C. 154(b) by 295 days.

(21) Appl. No.: 09/969,997

(22) Filed: Oct. 4, 2001

(65) Prior Publication Data

US 2003/0006953 A1 Jan. 9, 2003

(30) Foreign Application Priority Data

Jun. 12, 2001 (TW) ..... 90114225 A

(51) Int. Cl.[7] ..... G09G 3/36; G09G 5/00

(52) U.S. Cl. ..... 345/100; 345/204

(58) Field of Search ..... 345/92, 93, 98, 345/100, 103, 204, 205, 206; 349/149, 152

(56) References Cited

U.S. PATENT DOCUMENTS 4,842,371 A * 6/1989 Yasuda et al. ..... 345/103
5,585,815 A * 12/1996 Nakashima et al. ..... 345/100
5,648,790 A * 7/1997 Lee ..... 345/100
5,701,167 A * 12/1997 Yamazaki ..... 349/149

* cited by examiner

*Primary Examiner*—Chanh Nguyen
*Assistant Examiner*—Paul A. Bell
(74) *Attorney, Agent, or Firm*—Rabin & Berdo, P.C.

(57) ABSTRACT

A scan driving circuit and driving method for active matrix liquid crystal display is disclosed. The scan driving circuit comprises a switching circuit including a plurality of low-temperature poly-silicon MOS devices of same conductivity type formed on the liquid crystal display panel and a plurality of control signal input ports connected to the switching circuit, in which the number of the control signal input ports is less than that of the scan lines of the liquid crystal display panel, and the switching circuit is coupled between the scan lines and the control signal input ports. The driving method comprises providing a plurality of control signals consisted of sequential or back-and-forth pulses coupled to the control signal input ports from outside of the panel for operation of the switching circuit to drive the scan lines.

9 Claims, 4 Drawing Sheets

SCAN DRIVING CIRCUIT AND DRIVING METHOD FOR ACTIVE MATRIX LIQUID CRYSTAL DISPLAY

FIELD OF THE INVENTION

The present invention generally relates to a liquid crystal display (LCD), and more particularly, to a scan driving circuit and driving method for active matrix liquid crystal display (AMLCD).

BACKGROUND OF THE INVENTION

An active matrix liquid crystal display includes an array of thin film transistors (TFT) formed on a panel, which is controlled by external column and row signals to display images. A block diagram for a typical display system of an active matrix liquid crystal display is illustrated in FIG. 1, in which a liquid crystal controller 201 is provided with display data and synchronization signal by a signal bus 101 and transmits the display data and synchronization signal to a data driver 202 by a data signal bus 206, a first line marker (FLM) 207 and a clock 208 to a scan driver 203 for the activation and operation of the scan driver 203, and a crystal alternating signal 209 to a power supply 204. The color tone voltages generated by the data driver 202 are transmitted to a liquid crystal panel 205 by a drain bus 210, and the select/unselect signal generated by the scan driver 203 for scan lines are transmitted to the liquid crystal panel 205 by a gate bus 211. Among the voltages generated by the power supply 204, select voltage level Vgon 212 and unselect voltage level Vgoff 213 are supplied to scan driver 203, and the opposite electrode voltage 214 of the liquid crystal panel 205 and color tone voltage 215 of the data driver 202 are supplied to the liquid crystal panel 205. The TFT liquid crystal panel 205 includes a matrix crossed by the drain bus 210 and gate bus 211, and at the cross point a cell is formed with a TFT switch 216 and a pixel liquid crystal 217. The gate of the TFT device 216 is connected with the gate bus 211, the drain of the TFT device 216 is connected with the drain bus 210, the source 218 of the TFT device 216 is one of the electrodes of the pixel liquid crystal 217, and the opposite electrode 219 of the pixel liquid crystal 217 is connected with an opposite electrode line 214.

The liquid crystal display controller 201 converts the display data and synchronization signal transmitted by the signal bus 101 to be the display data and liquid crystal driving signal for driving the TFT liquid crystal display, and transmits the display data and liquid crystal driving signal to the data driver 202 by the signal bus 206, the liquid crystal display driving signal to the scan driver 203 with the FLM 207 and clock 208, and the liquid crystal alternating signal 209 to power supply 204. The data driver 202 sequentially fetches the display data from the signal bus 206, and, when the display data of a scan line is completely fetched, converts the display data to the color tone voltage corresponding to the scan line, which is in turn outputted from drain bus 210, and the data driver 202 repeats the process for each scan line as such. Synchronized to the event that the data driver 202 outputs the color tone voltage to the liquid crystal panel 205 by the drain bus 210, the scan driver 203 sequentially applies the select voltage to the gate bus 211. When the select voltage Vgon is applied on the gate bus 211, the TFT device 216 in the liquid crystal display panel 205 enters the selected state and applies the color tone voltage upon the pixel liquid crystal 217 by the drain bus 210, such that the actual voltage applied upon the pixel liquid crystal 217 varies the twist angle of the liquid crystal to control the transmittance of light, thus implements color tone display. Furthermore, when the unselect voltage Vgoff is applied by the gate bus 211, the TFT device 216 in the liquid crystal display panel 205 enters the unselected state and keeps the voltage applied on the liquid crystal 217. Repeat the process during the interval of a frame, and all TFT devices 216 will be selected.

The resolution of an image is dependent on the number of the pixels, and since a scan line controls the on/off of a row of TFT devices, the more the pixels are in a TFT array, the more there are scan lines, and thus the number of pins of a liquid crystal display panel increase. As a result, it is harder to connect the scan driver to the liquid crystal panel. Besides the apparent difficulty of reducing the external circuit of a liquid crystal display, the prior art driver circuit is not formed directly on the panel, thus circuit integration and simplification cannot be achieved, and when a new technology has been developed, such as the case that low-temperature poly-silicon (LTPS) process is applied to fabricate the liquid crystal display, advantages cannot be exploited. With the increasing resolution and complexity of the liquid crystal display, those problems are getting even worse. Therefore, it would be desirable for a scan driving circuit and driving method to provide a large enough number of scan lines with less control signals.

SUMMARY OF THE INVENTION

One object of the present invention is to provide a scan driving circuit and driving method for active matrix liquid crystal display with a plurality of switching devices formed on the liquid crystal display panel and coupled between a plurality of scan lines and a plurality of control signal input ports, in which the number of the control signal input ports are less than that of the scan lines, and one set of control signals coupled to the control signal input ports from outside of the panel to manipulate the switching devices to drive the scan lines. Thus the number of the pins that the panel has to provide to drive the scan lines is reduced in order.

Another object of the invention is the utilization of Metal-Oxide-Semiconductor (MOS) devices of the same conductivity type serving as the switching elements to simplify the circuit and its fabrication process.

Still another object of the invention is the formation of the switching devices with low-temperature poly-silicon MOS devices so as to reduce the cost and difficulty of fabrication.

Yet still another object of the invention is to provide sequential or back-and-forth pulse signals as the driving waveform of the set of control signals.

BRIEF DESCRIPTION OF THE DRAWINGS

For a better understanding of the present invention, reference may be had to the following description of exemplary embodiments thereof, considered in conjunction with the accompanying drawings, in which.

DETAILED DESCRIPTION OF THE INVENTION

Figure 2:
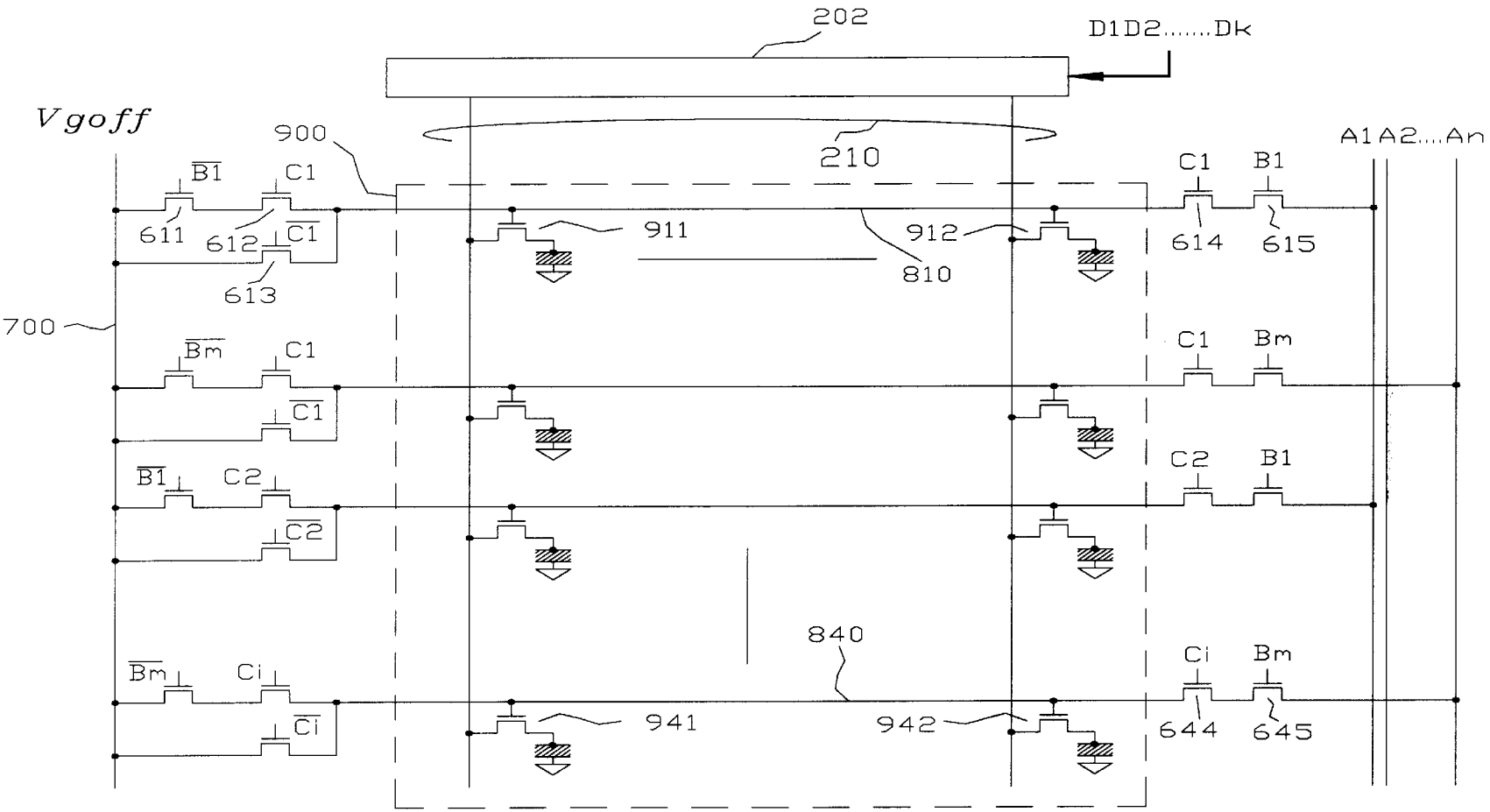
FIG. 2 is the schematic of a scan driving circuit according to the present invention.

FIG. 2 is the schematic of a scan driving circuit according to the present invention. Data driver 202 of this display system and its operation are the same as that of the prior art, and the present invention concentrates on the scan driving circuit and driving method of the system. As in the conventional display system, the liquid crystal display of the present invention comprises an array of TFT's formed on the panel and coupled to a plurality of scan lines, as shown in the figure, the first scan line 810 connects with the gates of the TFT devices in the first row, i.e., the gate of TFT device 911 at the first row and first column connects to scan line 810, and connections are repeated in the same manner until the gate of TFT device 912 at the first row and last column. The other scan lines are connected similarly, down to the last scan line 840. The gate of the TFT device 941 at the last row and first column connects to the last scan line 840. To simplify the diagram, the TFT array in this figure only shows some of the TFT devices, while the rest not shown are the same.

Driving the scan lines is practiced with a plurality of control signals from outside of the panel, and these control signals manipulate a plurality of switching devices to turn on or turn off the scan lines. In the embodiment shown in FIG. 2, the control signals are divided to three groups A, B, and C, in which the group A includes A1, A2, to An, N in total, the group B includes B1, B2, to Bm, M in total, and the group C includes C1, C2, to Ci, I in total. Furthermore, each signal in the group B and C has a complementary signal B and C. In addition, an unselect voltage Vgoff is provided. The switching devices are arranged for each scan line to be connected to two transmission circuits. One of them provides the control signal to turn on the scan line from the right side of the TFT array 900, the other provides the control signal to turn off the scan line from the left side of the TFT array 900. For instance, to the right of the first scan line 810, MOS devices 614 and 615 in series with each other are coupled between the scan line 810 and control signal A1, and the gates of these two switching devices are coupled to control signals B1 and C1 respectively, in which the MOS B1 and C1 serve as analog switches in series and signal A1 is the signal passing through these two switches. When signals B1 as well as C1 turn on MOS device 615 and 614, the control signal A1 is transmitted to scan line 810 through MOS 615 and 614 and thus activate the scan line 810 by its voltage level. At the other side of the scan line 810, another transmission circuit is inserted between the scan line 810 and unselect voltage Vgoff. This transmission circuit has two branches, one being MOS devices 611 and 612 in series, and the other being MOS device 613, and the gates of these three switching devices 611, 612, and 613 are coupled to control signal B1, C1 and C1 respectively. When the control signals B1 and C1 are simultaneously on, the transmission circuit (MOS devices 614 and 615) at the right side conducts the control signal A1 to the scan line 810, and, to the contrary, when one of the control signals B1 and C1 is off, the transmission circuit (MOS devices 614 and 615) at the right side is turned off. Meanwhile, the transmission circuit at the left side is turned on because the MOS devices 611 and 612 are turned on or the MOS device 613 is turned on, and conducts unselect voltage signal Vgoff to the scan line 810, and thus the TFT devices 911–912 at the first row is not selected. Other scan lines are operated in the same way, only with different control signals.

Figure 1:
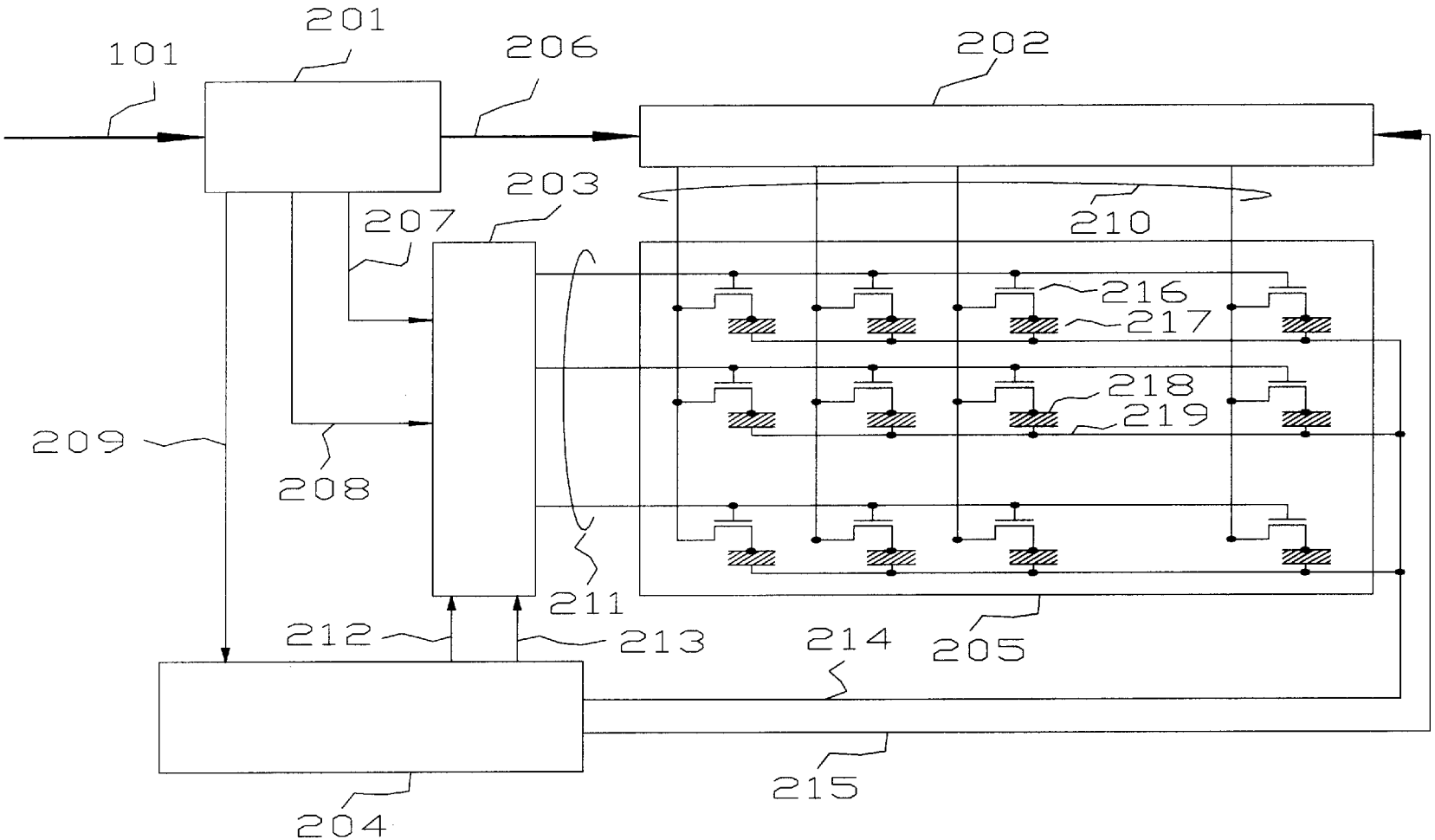
FIG. 1 (PRIOR ART)
FIG. 1 shows the display system block diagram of a traditional liquid crystal display.

To make a clear comparison with the traditional liquid crystal display panel, the TFT array is enclosed by dash line 900 in FIG. 2. However, the MOS devices at both sides of the array 900 are formed on the panel together with the array 900, which is different from the prior art (please refer to the apparatus of FIG. 1) and the conventional liquid crystal display does not include a scan driving circuit on the panel 205; all the scan driving circuit are formed in the scan driver 203 external to the panel 205.

In the embodiment of FIG. 2, a complete scan driver is divided to the scan pulse driving circuit and the scan driving circuit. The former is implemented with all circuitry, except for the analog switches, such as a shift register and level shifter in an integrated circuit to generate control signals, such as the above-mentioned control signals A, B and C. The latter is formed with MOS devices directly on the panel, and these MOS devices are of the same conductivity type, i.e., all PMOS devices or all NMOS devices, and when used in a low-temperature poly-silicon liquid crystal display, these MOS devices are fabricated along with the TFT array in a compatible process.

In the embodiment, the control signal group A has N signals, the control signal group B has M signals, and the control signal C has I signals, thus the scan lines they can drive are as many as I☞M☞N lines. The number of ports required to input these controls signals is N for the group A, and 2☞M and 2☞I for the group B and C respectively because of their complementary signals, therefore, the total number of the control signal input ports is 2☞(I+M)+N. If complementary signal generators, such as inverters, are formed directly on the panel for the group B and C, then all the complementary signals can be generated inside the panel, and the total number of the control signal input ports can be thus further reduced to I+M+N. To demonstrate the extent of the circuit reduction more clearly, the different numbers of the control signals A, B, and C that can support the scan lines in various resolutions are provided herewith as:

TABLE 1

| Display format standard | A | B | $\underline{B}$ | C | $\underline{C}$ | Number of pins | Number of scan lines |
|---|---|---|---|---|---|---|---|
| QCIF | 10 | 4 | 4 | 4 | 4 | 26 | 160 |
| QVGA | 12 | 5 | 5 | 4 | 4 | 30 | 240 |
| VGA | 16 | 5 | 5 | 6 | 6 | 38 | 480 |
| SVGA | 15 | 8 | 8 | 5 | 5 | 41 | 600 |
| XGA | 16 | 8 | 8 | 6 | 6 | 44 | 768 |
| SXGA | 16 | 8 | 8 | 8 | 8 | 48 | 1024 |

Obviously, if the conventional scan driving circuit were used, the number of pins would have been the same as that of the scan lines, while the pins can be drastically decreased if the scan driving circuit of the present invention is utilized, and the effect manifests itself more as the resolution gets higher.

Regarding the control signals for the scan lines as the addressing signals, as shown in FIG. 2, the control signals B and C are coupled to the control ports of the switching devices in the transmission circuits, namely the gates of the MOS devices at both side of the TFT array 900, and thus B and C can be regarded as control signals for two analog switches in series, and A is the signal passing through these two switches. When B and C are turned on, the voltage level on A turns on the scan line, and turning off the scan line is accomplished by applying Vgoff on both B and C or on C only. When the MOS devices 614 and 615 at the right side of the TFT array 900 are turned on by the control signals C1 and B1, the first to the Nth scan lines are selected and connected respectively to the control signals A1–An. Meanwhile the voltage on the control signal A1 is raised to the on level of the TFT device and the lines A2–An stay at the off level, and thus the TFT devices 911–912 on the first scan line 810 are turned on, as such, sequentially changing the control signals of the group A in order that the TFT devices on the second to the Nth scan lines are turned on in turn; after An is turned off, B1 is also turned off, then B2 is turned on so that the following N scan lines (namely the Nth to the 2Nth scan lines) are selected, and A1–An repeat the previous operation again, as a result, the first N scan lines which are previously selected by B1 and C1 as the above-described are coupled to the unselect voltage Vgoff since the switches C1 and B1 at the left side of the array 900 are turned on now, that is, these N scan lines are in the state of being unselected. By the same token, after B1 to Bm are switched sequentially, C1 is turned off, C2 is turned on, and A as well as B repeats the previous operation. Therefore, each signal of the group C addresses M signals of the group B, and each signal of the group B addresses N signals of the group A, since there are I signals in the group C, there are I☞M☞N scan lines in total.

Figure 3:
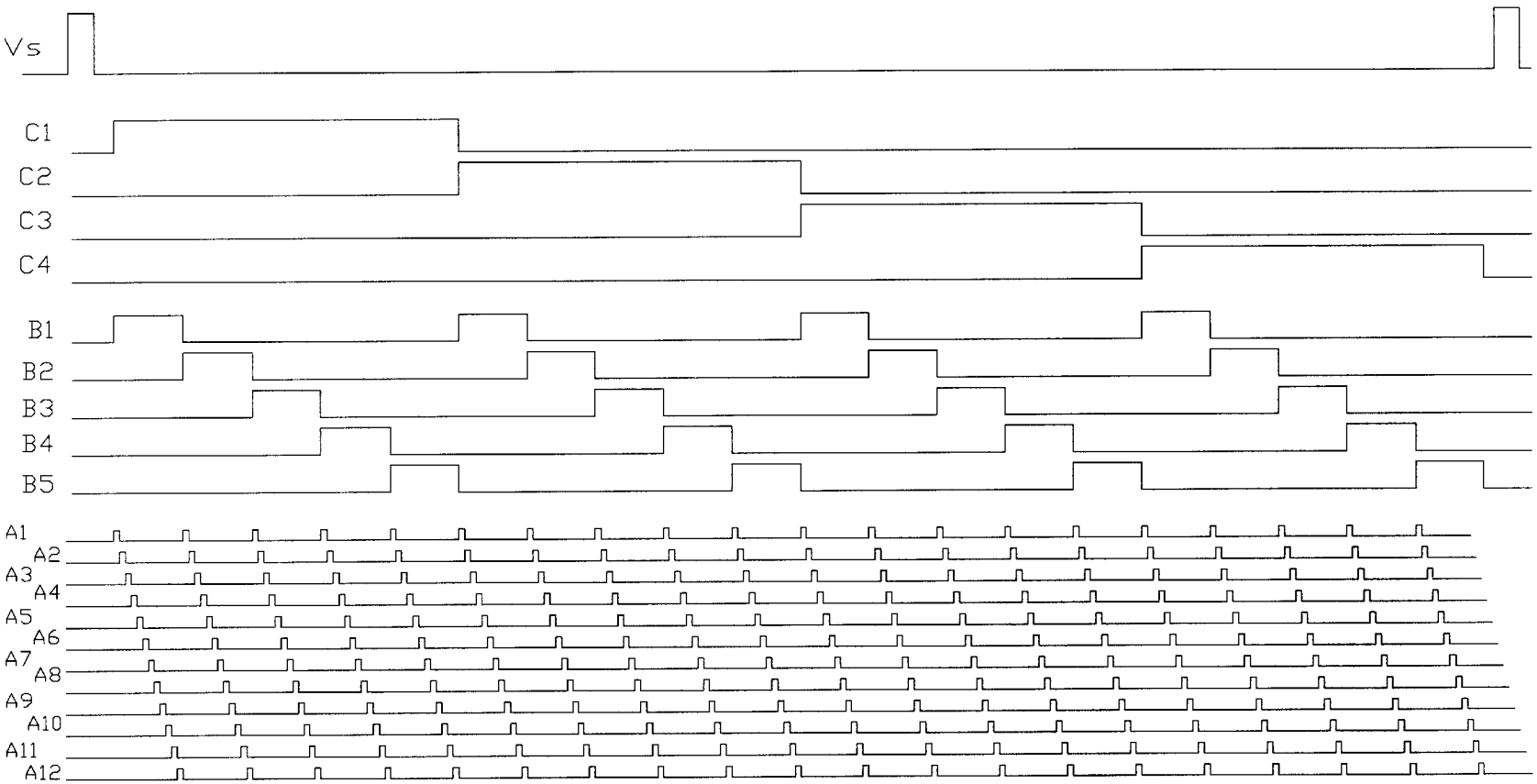
FIG. 3 shows the waveform of control signals for the circuit in FIG. 2.

FIG. 3 shows the complete waveform and timing diagram of the control signals during a frame for one embodiment QVGA display system with 240 scan lines, in which signals C1–C4, B1–B5, and A1–A12 are the control signals from outside of the panel, and for A1–A12, the pulse width stands for the duration of a scan line. As shown in the figure, C1–C4 are sequentially turned on within a frame duration, during the interval of each signal of the group C, B1–B5 are sequentially turned on, and during the interval of each signal of the group B, A1–A12 are sequentially turned on. The driving method sequentially turns on each group of the control signals.

Figure 4:
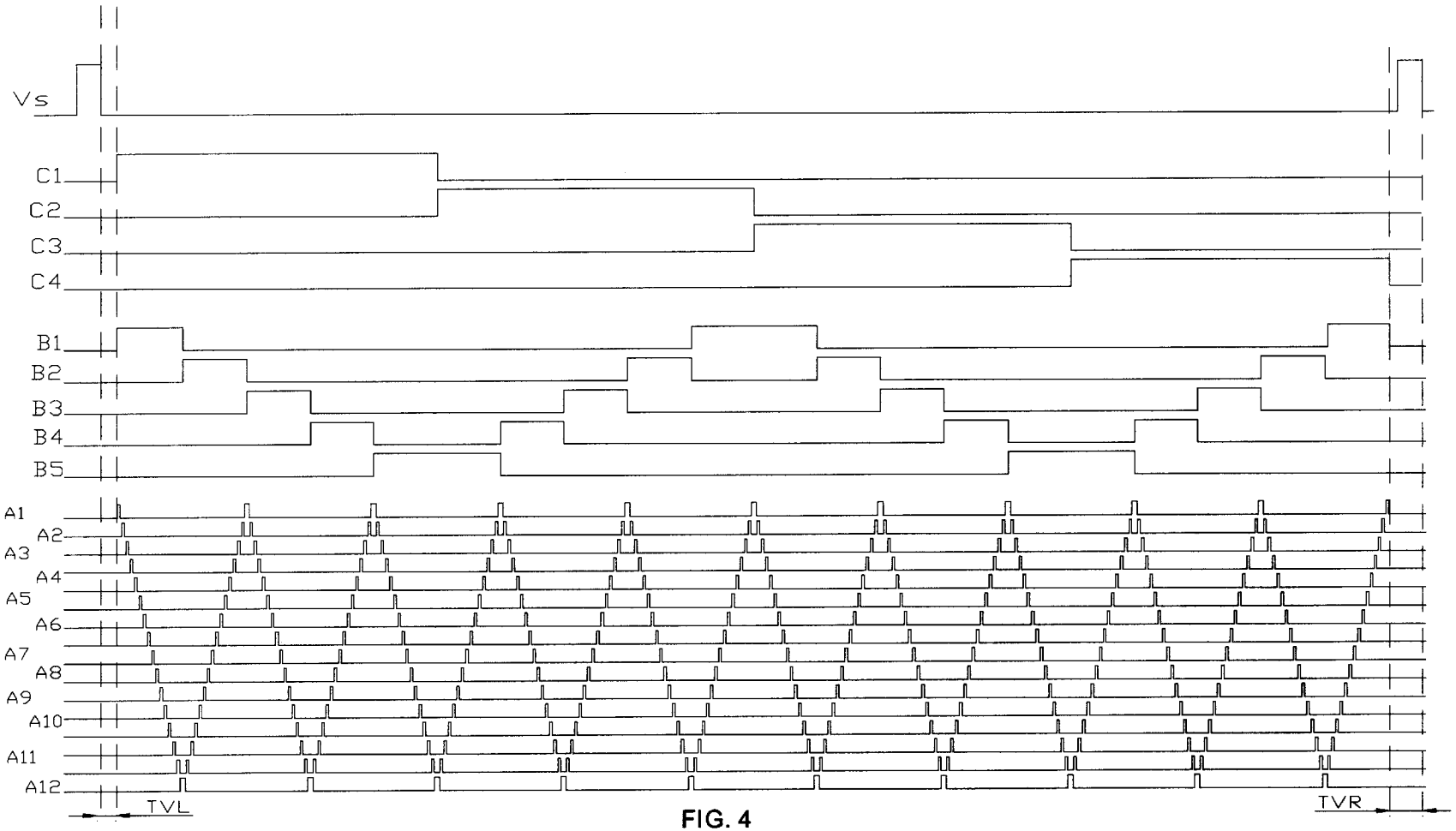
FIG. 4 shows the waveform of another control signals for the circuit in FIG. 2.

Another embodiment driving method is shown in FIG. 4, in which the control signals C's are also sequentially turns on, while during the period when the next signal C is turned on, B1–B5 are turned on in a reverse order opposite to that in the previous C period, thus in the duration of a frame, B1–B5 form a back-and-forth waveform, similarly, during the period when the next signal B is turned on, A1–A12 are turned on in a reverse order opposite to that in the previous B period, thus A1–A12 also form a back-and-forth waveform in the duration of a frame. The feature of this driving method is that the transition between any two adjacent scan lines is accomplished by switching of only one of the control signals A, B, and C, i.e., when A is switching, other control signals B and C are not switching, the same situation applies when B or C is switching. Furthermore, the control signals are not activated until a delay time TVL elapses after the completion of the start signal Vs, and upon the completion of a delay time TVR elapsed before the completion of the start signal for the next frame.

From the above, it should be understood that the embodiments described, in regard to the drawings, are merely exemplary and that a person skilled in the art may make variations and modifications to the shown embodiments without departing from the spirit and scope of the present invention. All variations and modifications are intended to be included within the scope of the present invention as defined in the appended claims.

What is claimed is:

1. A scan driving circuit formed on an active matrix liquid crystal display panel, comprising:

a scan line;

a first control signal line for inputting a first control signal from outside of said panel;

a first transmission circuit with a signal input port connected to said first control signal line, a signal output port connected to said scan line, and at least one control signal input port for switching said first transmission circuit;

an unselect voltage signal line for providing an unselect voltage signal;

a second transmission circuit with a signal input port connected to said unselect voltage signal line, a signal output port connected to said scan line, and at least one control signal input port for switching said second transmission circuit; and Z pairs of complementary second control signal lines connected respectively to said control signal input ports of said first and second transmission circuits for inputting Z pairs of complementary second control signals to determine whether or not said scan line is connected to said first control signal line or unselect voltage signal line.

2. A circuit according to claim 1, wherein said first and second transmission circuits comprise MOS devices of a predetermined conductivity type.

3. A circuit according to claim 1, wherein said first and second transmission circuits comprise low-temperature poly-silicon MOS devices.

4. A circuit according to claim 1, wherein said first transmission circuit comprises a plurality of switching devices in series between its signal input and output ports, each of said switching devices being controlled by one of said second control signals.

5. A circuit according to claim 1, wherein said second transmission circuit comprises N branches in parallel between its signal input and output ports, each of said branches being controlled by one of said complementary second control signals.

6. A driving method for an active matrix liquid crystal display having a first number of scan lines formed on a panel, said scan lines being coupled to a plurality of switching devices formed on said panel, said switching devices being coupled with a second number of control signals from outside of said panel, said second number being less than said first number, said control signals being divided into first to Zth groups with said second to Zth groups of said control signals each having a complementary signal pair to operate said switching devices so as to selectively couple said first group of control signals to said scan lines, said method comprising the steps of:

providing a start signal;

sequentially turning on said Zth group of control signals;

sequentially turning on said (Z–1)th group of control signals during each turning on of said Zth group of control signals;

sequentially turning on said (Z–2)th group of control signals during each turning on of said (Z–1)th group of control signals; and repeating until sequentially turning on said first group of control signals during each turning on of said second group of control signals.

7. A driving method for an active matrix liquid crystal display having a first number of scan lines formed on a panel, said scan lines being coupled to a plurality of switching devices formed on said panel, said switching devices being coupled with a second number of control signals from outside of said panel, said second number being less than said first number, said control signals being divided into first to Zth groups with said second to Zth groups of said control signals each having a complementary signal pair to operate said switching devices so as to selectively couple said first group of control signals to said scan lines, said method comprising the steps of:

providing a start signal;

sequentially turning on said Zth group of control signals; and sequentially turning on said (Z–1)th to first group of control signals during each turning on of said Zth group of control signals;

wherein each transition between any two adjacent scan lines is accomplished by switching of only one of said control signals.

8. A method according to claim 7, further comprising waiting for a delay time after said start signal.

9. A method according to claim 7, further comprising waiting for a delay time after completion of turning on said Zth group of control signals.

* * * * *